US012690688B2

(12) United States Patent
Pao

(10) Patent No.: US 12,690,688 B2
(45) Date of Patent: Jul. 28, 2026

(54) FOLDABLE DEVICE WITH AN AUTOMATIC SPREADING POSITIONING FUNCTION

(71) Applicant: STEP2GOLD CO., LTD., Taichung City (TW)

(72) Inventor: Chih-Ting Pao, Taichung City (TW)

(73) Assignee: STEP2GOLD CO., LTD., Taichung City (TW)

( * ) Notice: Subject to any disclaimer, the term of this patent is extended or adjusted under 35 U.S.C. 154(b) by 44 days.

(21) Appl. No.: 18/924,374

(22) Filed: Oct. 23, 2024

(65) Prior Publication Data

US 2025/0143471 A1 May 8, 2025

(30) Foreign Application Priority Data

Nov. 2, 2023 (TW) ..... 112142248

(51) Int. Cl.
*A47C 9/10* (2006.01)

(52) U.S. Cl.
CPC ..... *A47C 9/10* (2013.01)

(58) Field of Classification Search
CPC ..... A47B 3/0812; A47C 4/14; A47C 4/16; A47C 4/24; A47C 4/26; A47C 4/286; A47C 9/10; A47C 9/105
See application file for complete search history.

(56) References Cited

U.S. PATENT DOCUMENTS 6,270,156 B1 * 8/2001 Metzger ..... A47C 4/286 297/16.2
10,010,179 B1 * 7/2018 Stump ..... A47C 4/44
2022/0061535 A1 * 3/2022 Pao ..... A47C 9/105

FOREIGN PATENT DOCUMENTS

FR 3000519 A1 * 7/2014 ..... A47B 3/0812
TW M467398 12/2013

* cited by examiner

*Primary Examiner* — Matthew W Ing
(74) *Attorney, Agent, or Firm* — Burris Law, PLLC

(57) ABSTRACT

A foldable device includes a pivot base having a through hole and two support holes extending through a base seat for a shaft member and two support shafts to extend therethrough. The shaft member extends along a central axis and is pivotably connected with the base seat about a rotating axis such that the shaft member is rotatable between a ready position and a swung position. The biasing member is interposed between the base seat and the shaft member to have a torque which urges the shaft member to rotate toward the swung position. During rotation of the shaft member to the swung position, the shaft member actuates the support shafts to rotate and spread relative to the base seat and to be inclined and intersect one another.

7 Claims, 13 Drawing Sheets

FOLDABLE DEVICE WITH AN AUTOMATIC SPREADING POSITIONING FUNCTION

CROSS-REFERENCE TO RELATED APPLICATION

This application claims priority to Taiwanese Patent Application No. 112142248, filed on Nov. 2, 2023, and incorporated by reference herein in its entirety.

FIELD

The disclosure relates to a foldable device, and more particularly to a foldable device with an automatic spreading positioning function.

BACKGROUND

A conventional folding crutch chair disclosed in TWM467398U includes a positioning seat, three rotatable legs rotatably extending through the positioning seat, a cloth disposed on upper ends of the legs, and two tie wraps disposed on upper and lower ends of one of the legs. The cloth is spread out by the legs when the legs are unfolded to provide a sitting surface. When the folding crutch chair is folded, the legs are closed to and parallel to one another and the tie wraps surround the upper and lower ends of the legs to secure them together. However, when unfolding the folding crutch chair, a user is required to manually spread out the legs, which is labor-intensive and time-consuming, and the user may face the risk of pinching his/her hands.

SUMMARY

Therefore, an object of the disclosure is to provide a foldable device with an automatic spreading positioning function that can alleviate at least one of the drawbacks of the prior art.

According to the disclosure, the foldable device includes a support unit and a biasing member. The support unit includes a pivot base, two support shafts and a shaft member. The pivot base includes a base seat, a through hole and two support holes, each of which extends through the base seat in a first direction. The support shafts respectively extend through the support holes and are pivotably connected with the base seat. The shaft member extends through the through hole and along a central axis. The shaft member is pivotably connected with the base seat to be rotatable relative to the base seat about a rotating axis which is transverse to a direction of the central axis such that the shaft member is rotatable relative to the base seat between a ready position, where the shaft member extends parallel to the first direction, and a swung position, where the shaft member is inclined relative to the first direction by an inclined angle. The biasing member is interposed between the base seat and the shaft member to have a torque which urges the shaft member to rotate toward the swung position. When the shaft member is in the ready position, the support shafts extend parallel to the shaft member. During rotation of the shaft member to the swung position, the shaft member actuates the support shafts to rotate and spread relative to the base seat and to be inclined and intersect one another.

With the biasing member urging the shaft member to rotate to the swung position, and the shaft member actuating the support shafts, the shaft member and the support shafts are automatically rotatable and are spread and retained to a spread state.

BRIEF DESCRIPTION OF THE DRAWINGS

Other features and advantages of the disclosure will become apparent in the following detailed description of the embodiments with reference to the accompanying drawings. It is noted that various features may not be drawn to scale.

DETAILED DESCRIPTION

Figure 1:
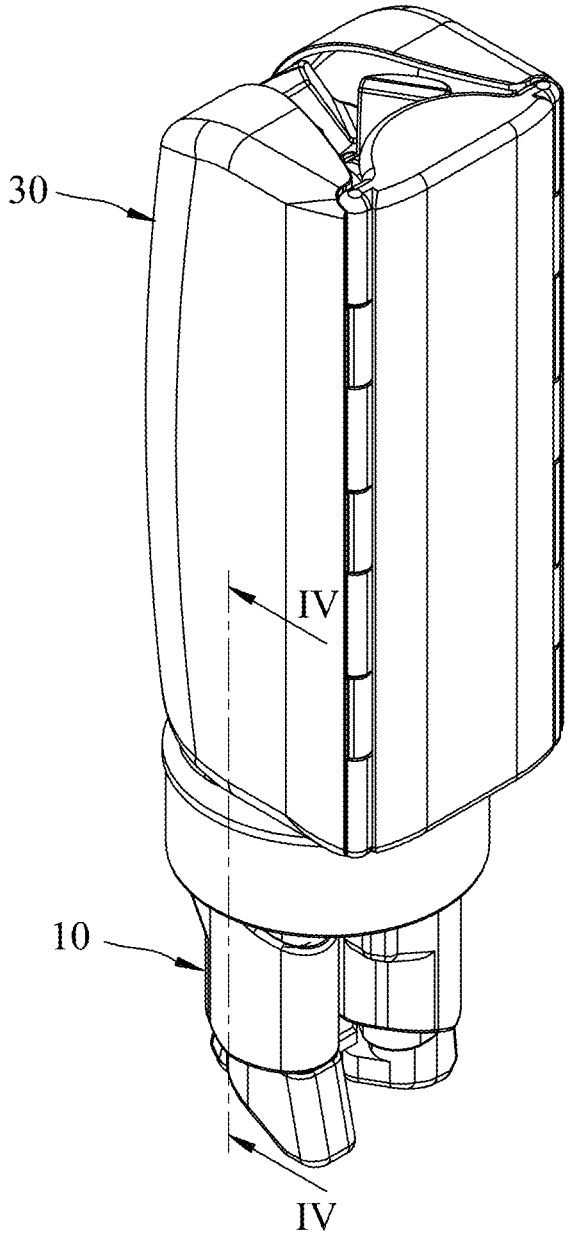
FIG. 1 is a perspective view illustrating an embodiment of a foldable device according to the disclosure in a folded state.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly. In the following description, a first direction (Z), a second direction (X) and a third direction (Y) are transverse to one another. The first direction (Z) is substantially an up-down direction.

Figure 2:
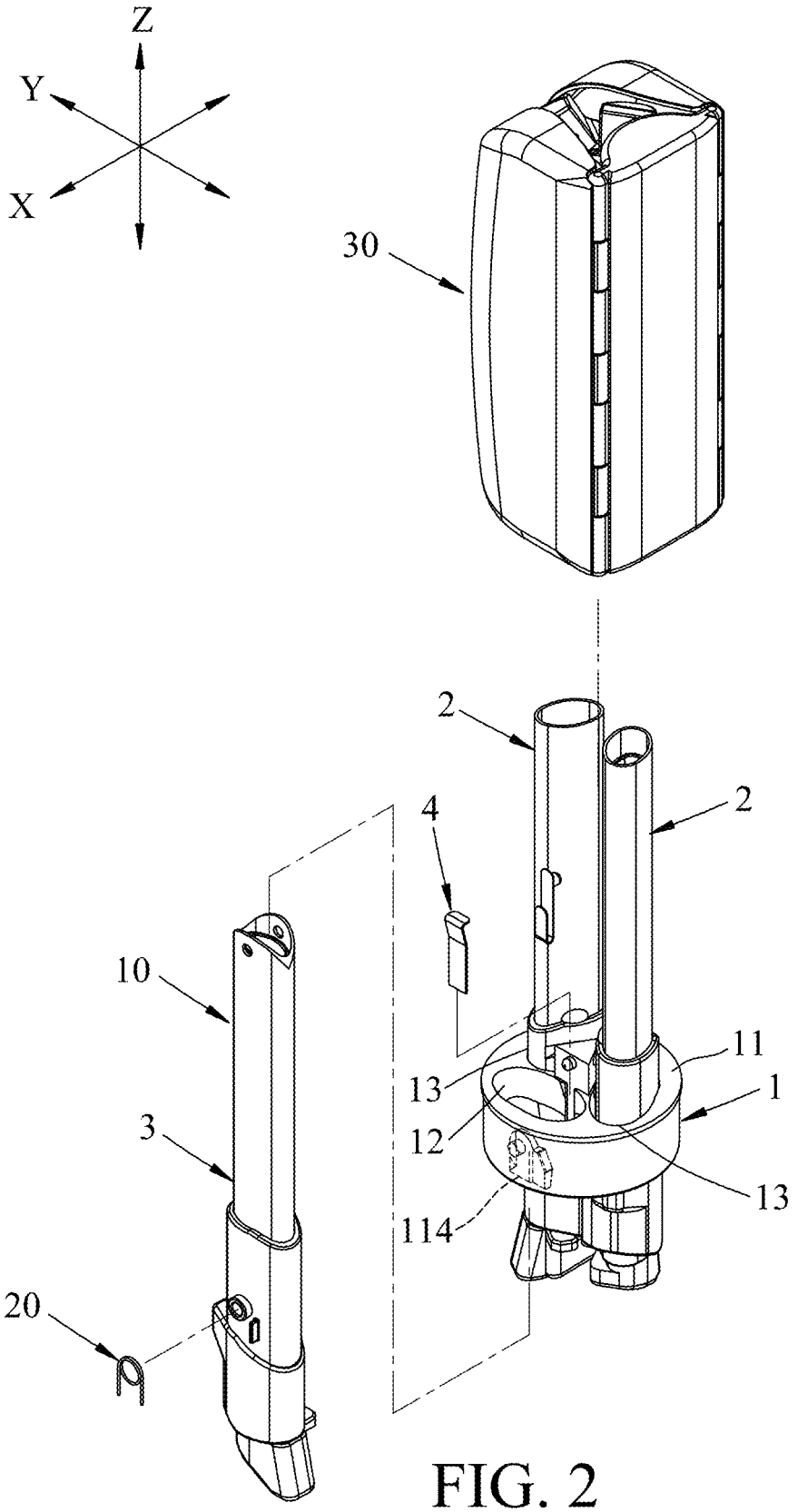
FIG. 2 is an exploded perspective view of the embodiment.

Referring to FIGS. 1 and 2, an embodiment of a foldable device according to the disclosure includes a support unit 10, a biasing member 20 and a foldable unit 30.

The support unit 10 includes a pivot base 1, two support shafts 2, a shaft member 3 and a locking member 4.

Figure 3:
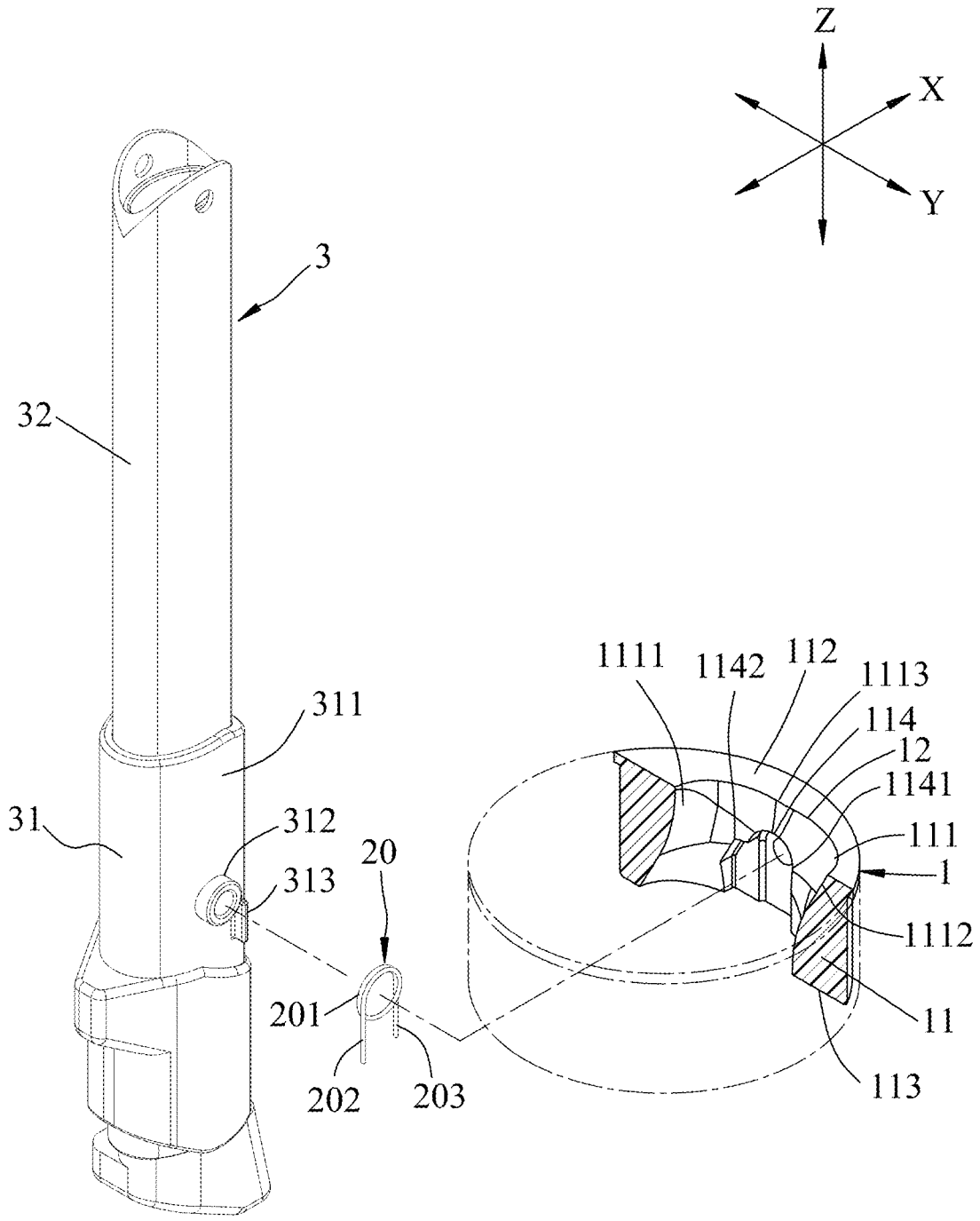
FIG. 3 is a fragmentary exploded perspective view of a pivot base and a shaft member of a support unit and a biasing member of the embodiment.
Figure 4:
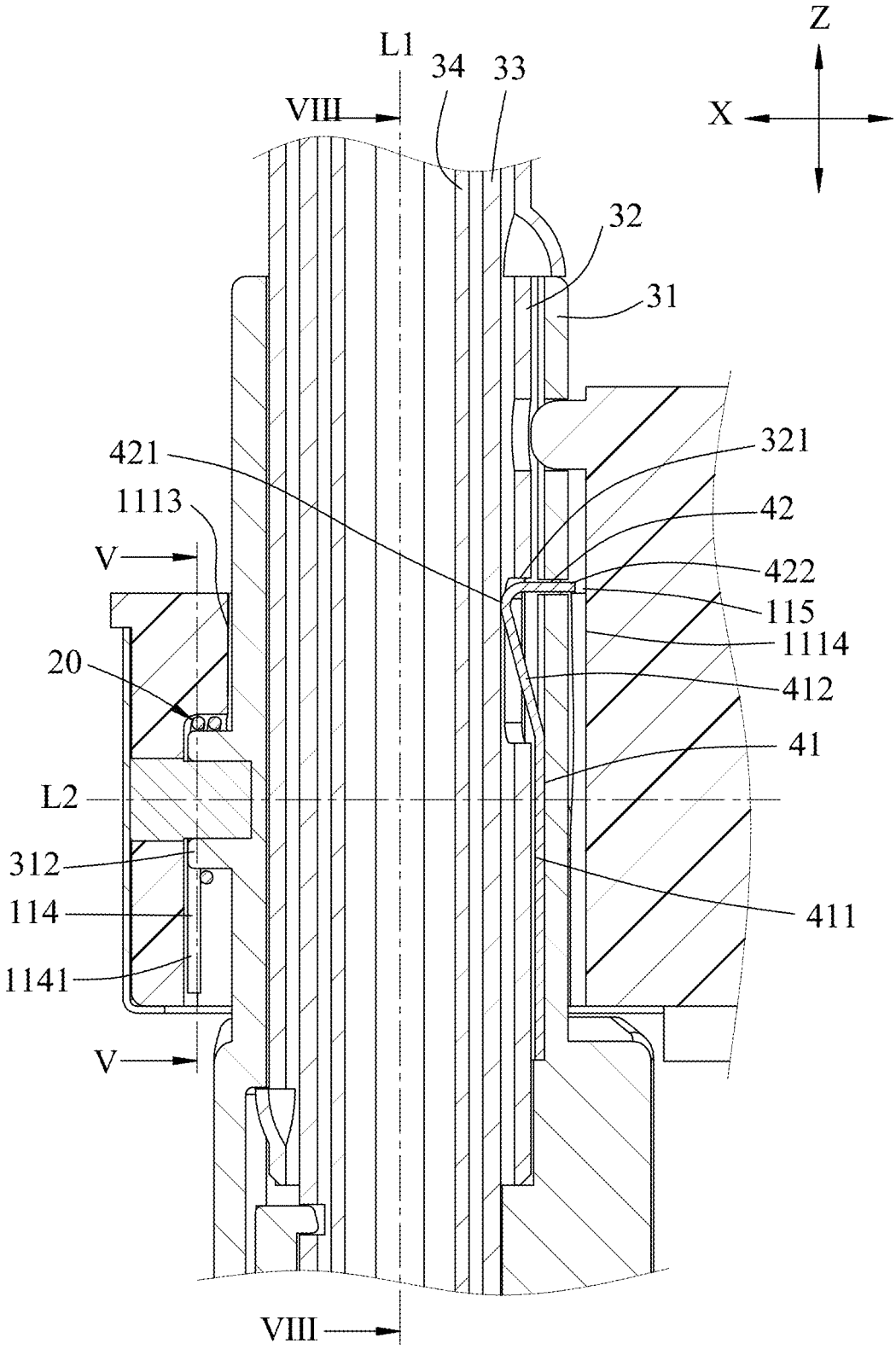
FIG. 4 is a sectional view taken along line IV-IV of FIG. 1, two support shafts being removed for the sake of clarity.

The pivot base 1 includes a base seat 11, a through hole 12 and two support holes 13, each of which extends through the base seat 11 in the first direction (Z). With reference to FIGS. 3 and 4, the base seat 11 has an inner seat wall 111 which defines the through hole 12, a first end wall 112 and a second end wall 113 which are respectively connected with two sides of the inner seat wall 111 along the first direction (Z) and opposite to each other. The first end wall 112 is disposed upwardly of the second end wall 113.

The inner seat wall 111 has a first inner wall section 1111 and a second inner wall section 1112 which are opposite to each other along the third direction (Y), and at two sides of the through hole 12, respectively, and a first connecting wall section 1113 and a second connecting wall section 1114, each of which interconnects the first inner wall section 1111 and the second inner wall section 1112 and which face and are opposite to each other in the second direction (X). Each of the first inner wall section 1111 and the second inner wall section 1112 extends and is inclined relative to the first direction (Z). The first connecting wall section 1113 is located at a radially outward side of the base seat 11 in relation to the second connecting wall section 1114. The first connecting wall section 1113 has a pivot slot 114 formed adjacent to the through hole 12. The pivot slot 114 includes a first slot section 1141 and a second slot section 1142 in communication with the first slot section 1141 and formed between the first slot section 1141 and the first inner wall section 1111. The second connecting wall section 1114 has an engaging slot 115 formed adjacent to the through hole 12.

Figure 5:
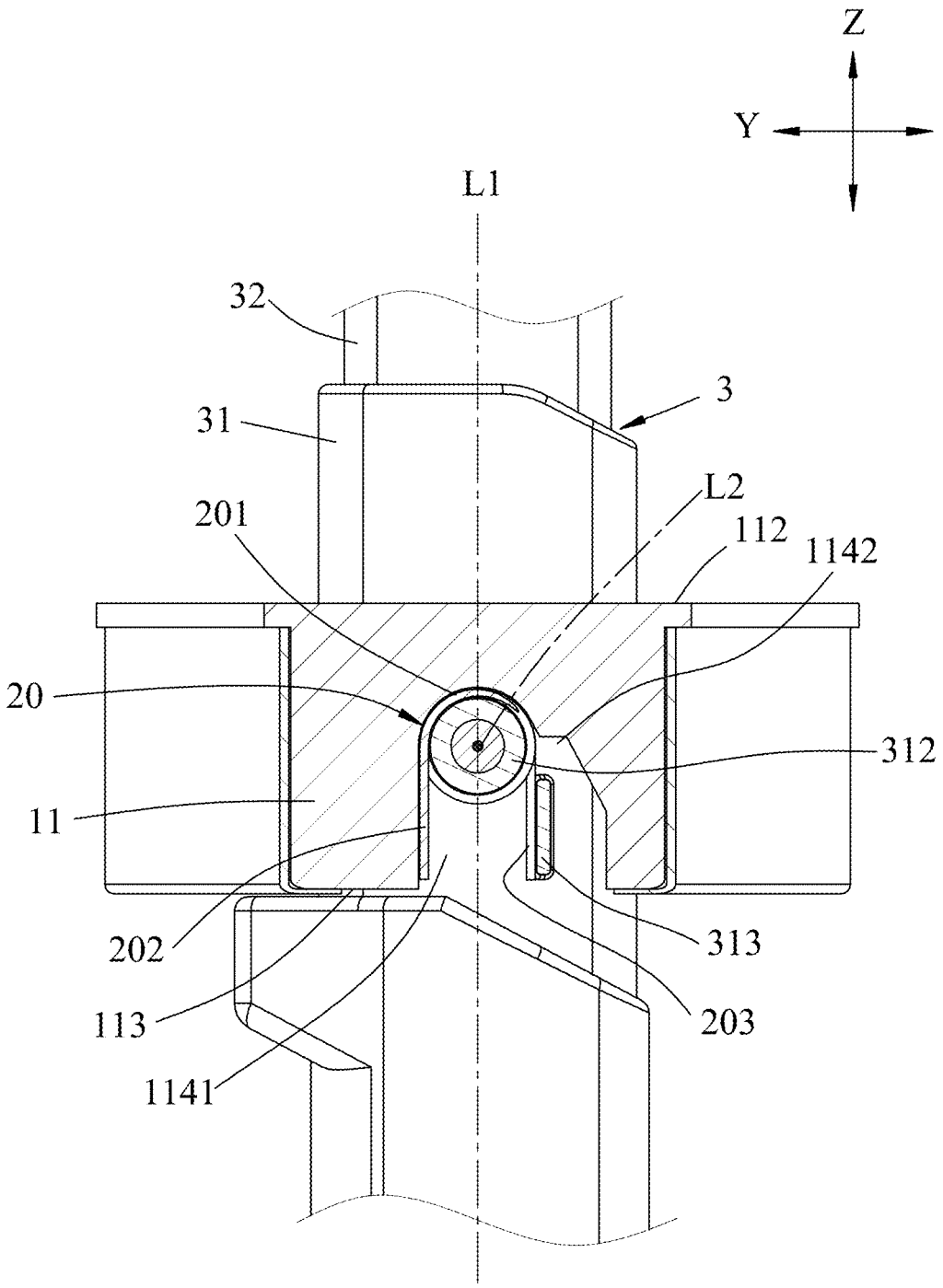
FIG. 5 is a sectional view taken along line V-V of FIG. 4.

With reference to FIGS. 2, 4 and 5, the support shafts 2 respectively extend through the support holes 13 and are pivotably connected with the base seat 11.

The shaft member 3 extends through the through hole 12 and along a central axis (L1). The shaft member 3 has a tubular pivot seat 31 which surrounds the central axis (L1) and which is pivotably connected with the base seat 11, a fixed tubular piece 32 which is securely connected with and disposed within the pivot seat 31, a middle tubular piece 33 which is movably disposed within the fixed tubular piece 32, and an inner tubular piece 34 which is movably disposed within the middle tubular piece 33.

With reference to FIGS. 3 to 5, the pivot seat 31 has a tubular seat wall 311, a pivot pin 312 which projects from the seat wall 311, and an abutted protrusion 313 which projects from the seat wall 311 and which is spaced apart from the pivot pin 312. The pivot pin 312 extends along a rotating axis (L2) in the second direction (X), and is rotatably disposed in the first slot section 1141. The rotating axis (L2) is transverse to the central axis (L1) and extends through the first slot section 1141 and the second connecting wall section 1114 such that the shaft member 3 is rotatable relative to the base seat 11 about the rotating axis (L2). The abutted protrusion 313 is received in the second slot section 1142, and is movable in the second slot section 1142 along with the rotation of the shaft member 3.

Figure 6:
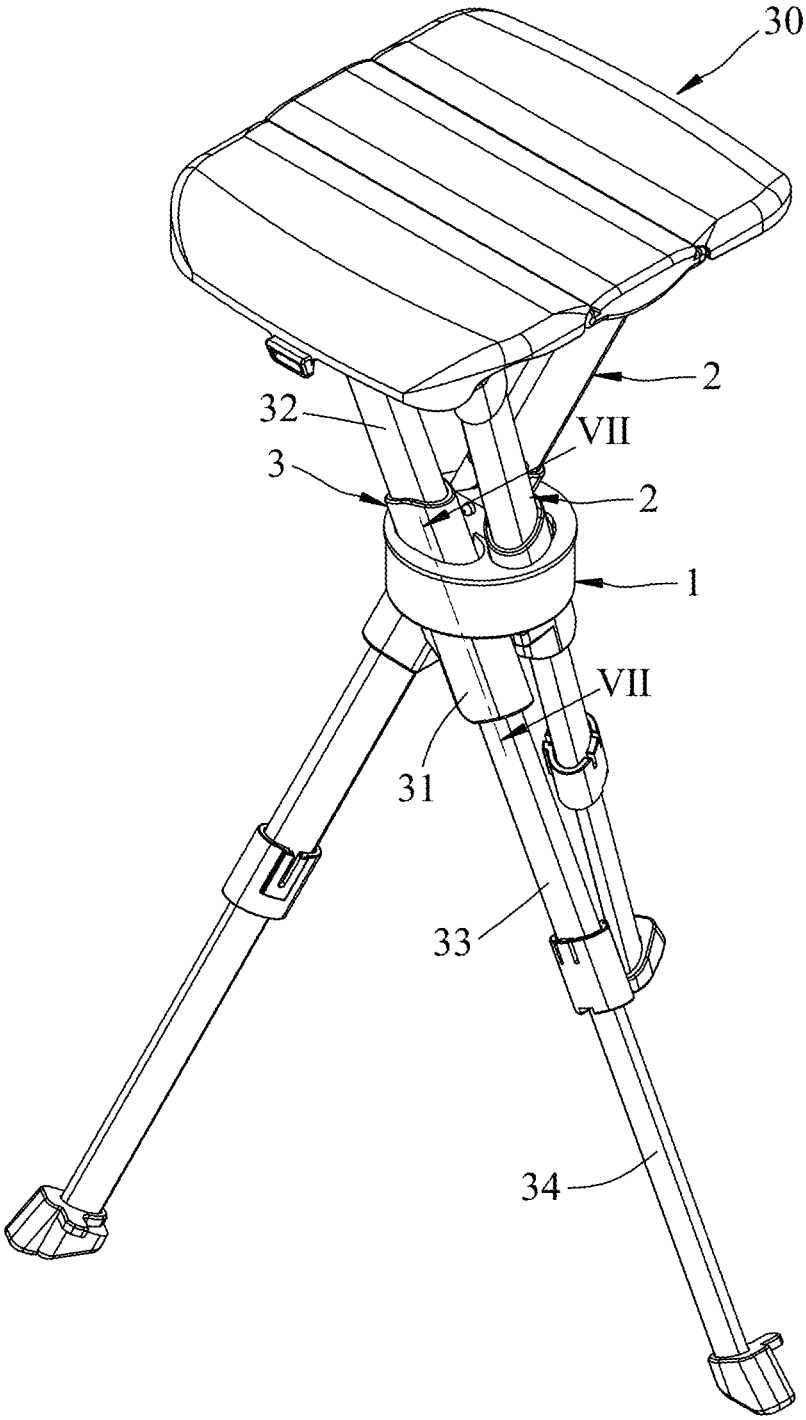
FIG. 6 is a perspective view of the embodiment in a spread state.
Figure 7:
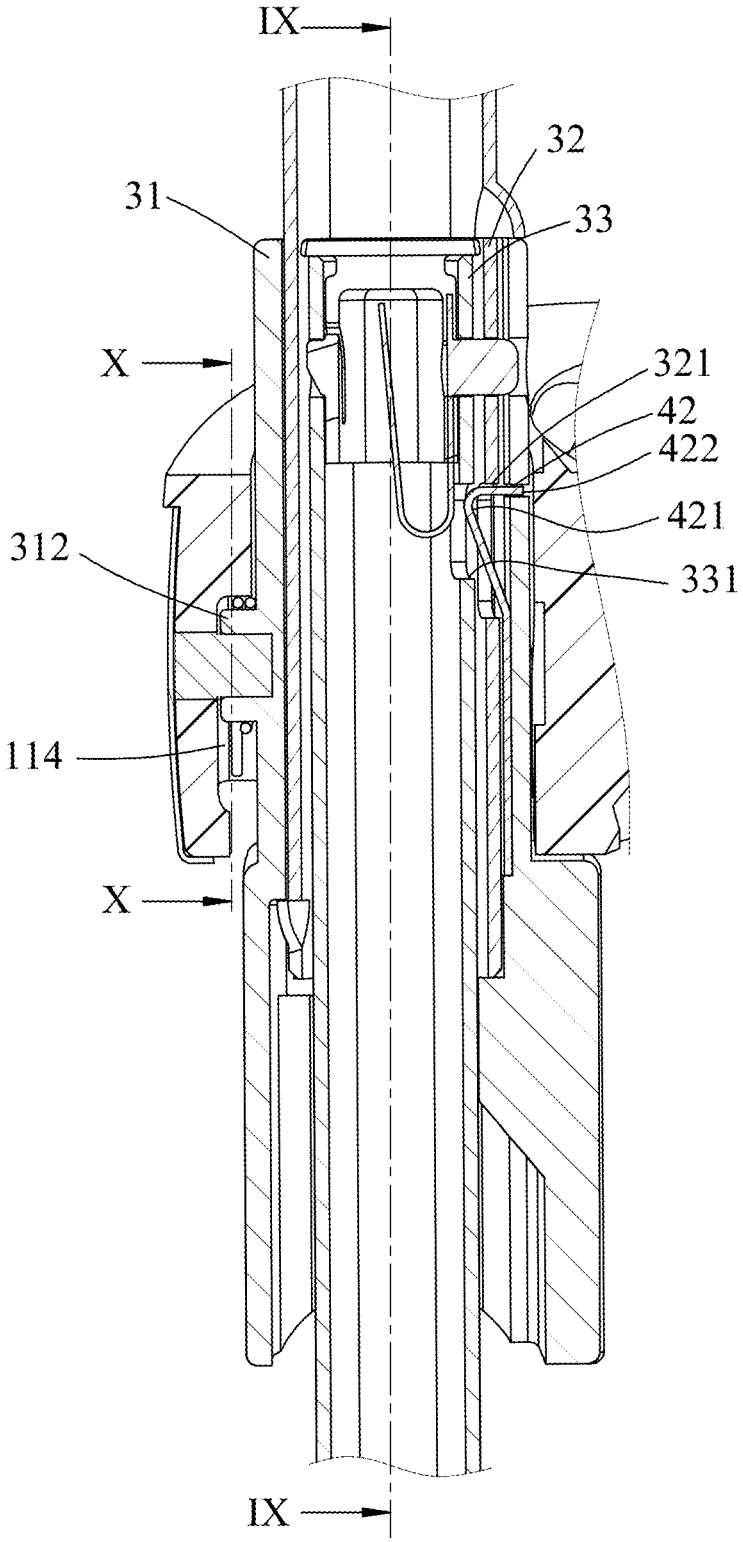
FIG. 7 is a sectional view taken along line VII-VII of FIG. 6, the support shafts being removed for the sake of clarity.

With reference to FIGS. 4, 6 and 7, the fixed tubular piece 32 has a radial hole 321 extending radially relative to the central axis (L1) therethrough. The middle tubular piece 33 has a retreat hole 331 extending radially relative to the central axis (L1) therethrough.

The locking member 4 is in the form of an integrally formed leaf spring which is bent with two bending joints, and is disposed at a side of the pivot seat 31 diametrically opposite to the pivot pin 312 along the rotating axis (L2). The locking member 4 includes a deformable portion 41 and a locking portion 42. The deformable portion 41 has a secured section 411 securely disposed between the pivot seat 31 and the fixed tubular piece 32, and a spring section 412 extending from and inclined relative to the secured section 411 toward the middle tubular piece 33. The locking portion 42 has an abutted end 421 which is connected with an end of the spring section 412 and adjacent to the middle tubular piece 33, and an engaging end 422 which extends from the abutted end 421 along the direction parallel to the rotating axis (L2) and away from the middle tubular piece 33 and extends through the pivot seat 31.

The spring section 412 is bent from the secured section 411 at an included angle which is greater than 90 degrees. The deformable portion 41 has a biasing force which urges the locking portion 42 toward the middle tubular piece 33. The abutted end 421 is bent relative to the spring section 412 at a bending angle which is smaller than 90 degrees.

With reference to FIGS. 4 and 5, the biasing member 20 is interposed between the first connecting wall section 1113 and the shaft member 3. The biasing member 20 is in the form of a coil spring, and has a coil portion 201 disposed on the shaft member 3 and received in the first slot section 1141, a first arm portion 202 extending from an end of the coil portion 201, and a second arm portion 203 extending from an opposite end of the coil portion 201. The pivot pin 312 extends along the rotating axis (L2) and through the coil portion 201. The first arm portion 202 and the second arm portion 203 extend toward the second end wall 113. The first arm portion 203 is disposed between the first arm portion 202 and the abutted protrusion 313. The coil portion 201 has a biasing force to urge the first arm portion 202 to abut against the base seat 11 and to urge the second arm portion 203 to abut against the abutted protrusion 313.

In this embodiment, each support shaft 2 is in the form of a telescopic tubular piece similar to the shaft member 3, and is different from the shaft member 2 in that the support shaft 2 is free from the locking member 4 and the biasing member 20. In other various embodiments, the support shaft 20 may be in the form of telescopic tubular pieces with the locking member 4 and the biasing member 20.

With reference to FIGS. 2 and 6, the foldable unit 30 is foldably disposed on upper ends of the shaft member 3 and the support shafts 2, and is actuated to spread with the shaft member 3 and the support shafts 2 in a known manner for a user to sit thereon.

Figure 8:
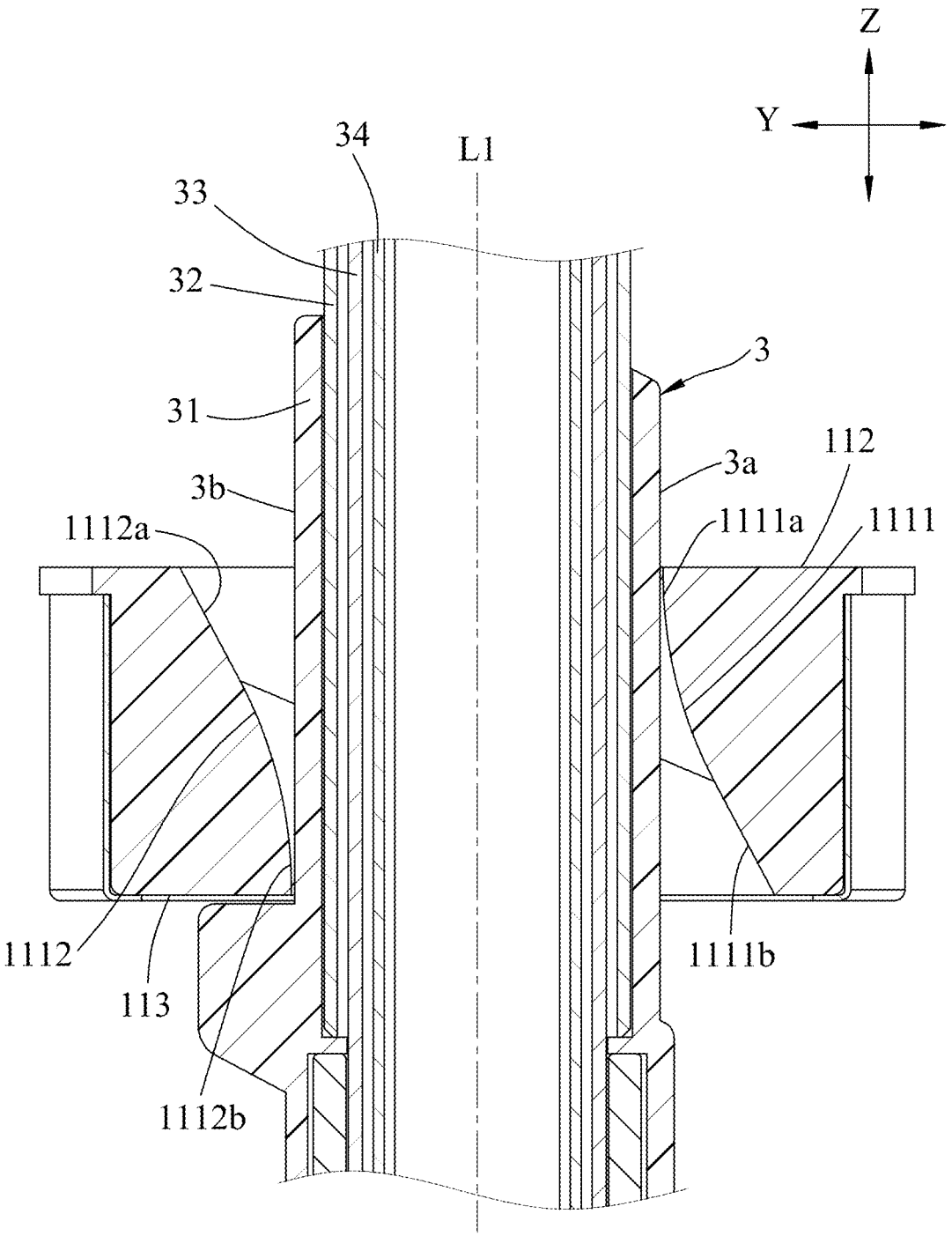
FIG. 8 is a sectional view taken along line VIII-VIII of FIG. 4.
Figure 9:
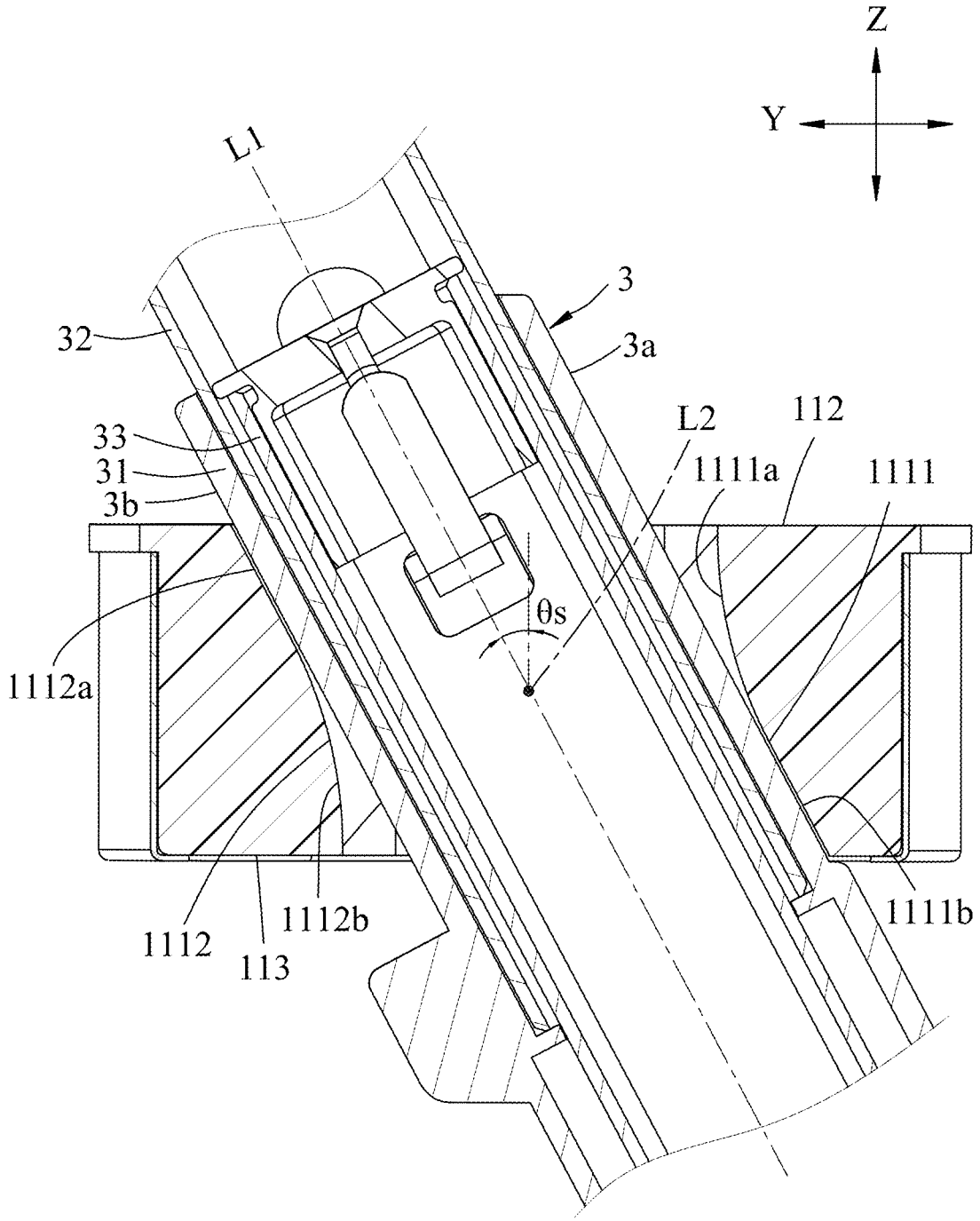
FIG. 9 is a sectional view taken along line IX-IX of FIG. 7.

With reference to FIGS. 5, 8 and 9, the shaft member 3 is rotatable relative to the base seat 11 between a ready position, where the shaft member 3 extends parallel to the first direction (Z), and a swung position, where the shaft member 3 is inclined relative to the first direction (Z) by an inclined angle(es). The biasing member 20 has a torque which urges the shaft member 3 to rotate toward the swung position. The torque is generated from the biasing force of the coil portion 201.

Specifically, with reference to FIGS. 2, 5 and 8, when the shaft member 3 is in the ready position, a first side (3*a*) of the shaft member 3 facing the first inner wall section 1111 abuts against a first portion (1111*a*) of the first inner wall section 1111 proximate to the first end wall 112, and is spaced apart from a second portion (1111*b*) of the first inner wall section 1111 proximate to the second end wall 113, and a second side (3*b*) of the shaft member 3 facing the second inner wall section 1112 abuts against a second portion (1112*b*) of the second inner wall section 1112 proximate to the second end wall 113, and is spaced apart from a first portion (1112*a*) of the second inner wall section 1112 proximate to the first end wall 112. Meanwhile, the first and second arm portions 202, 203 are closer to each other when the shaft member 3 is in the ready position. The first arm portion 202 abuts against the base seat 11, and the second arm portion 203 abuts against the abutted protrusion 313.

Figure 10:
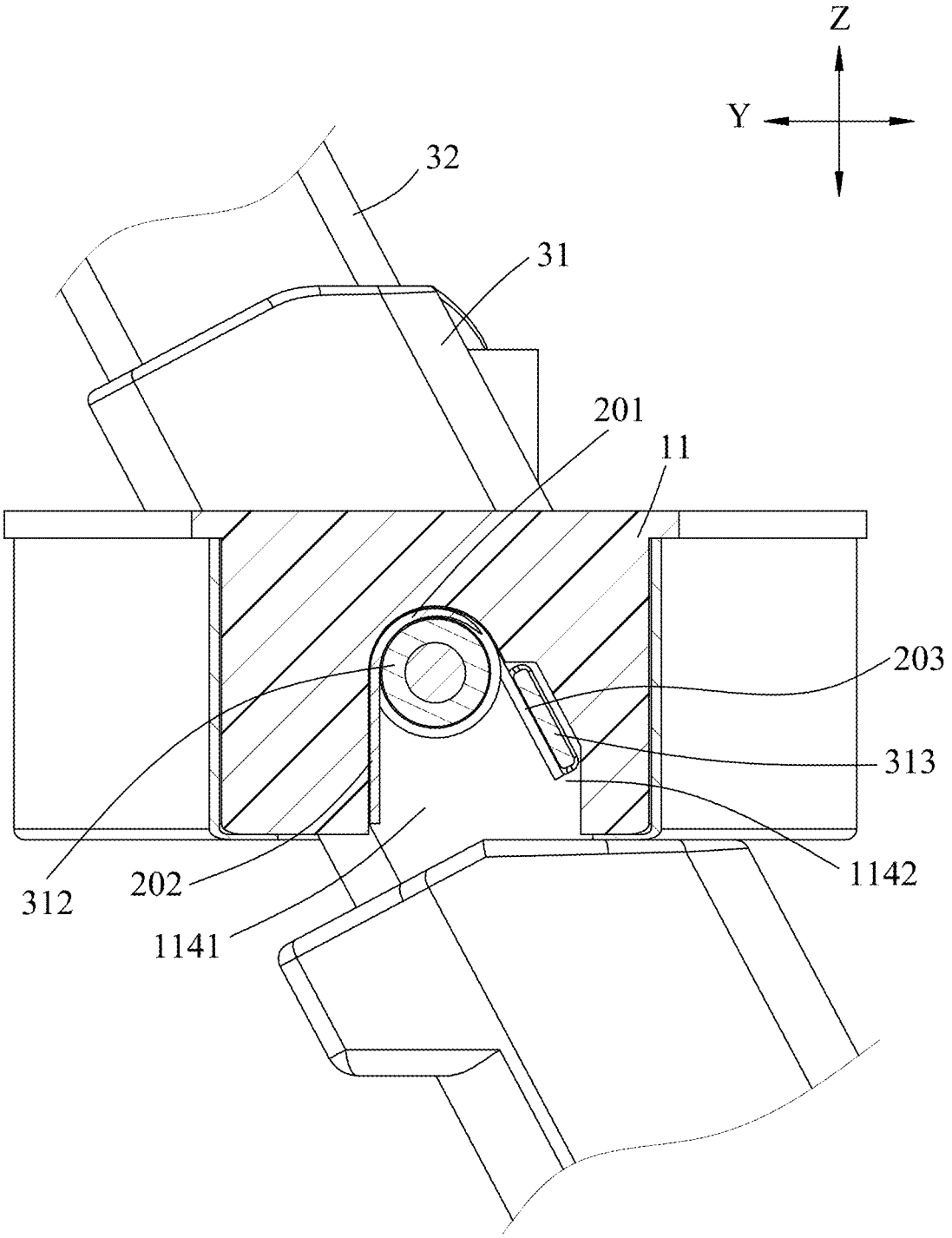
FIG. 10 is a sectional view taken along line X-X of FIG. 7.

With reference to FIGS. 6, 9 and 10, when the shaft member 3 is in the swung position, the second arm portion 203 abuts against the abutted protrusion 313 to be remoter from the first arm portion 202, the first side (3*a*) of the shaft member 3 facing the first inner wall section 1111 abuts against the second portion (1111*b*) proximal to the second end wall 113, and is spaced apart from the first portion (1111*a*) proximal to the first end wall 112, and the second side (3*b*) of the shaft member 3 facing the second inner wall section 1112 abuts against the first portion (1112*a*) proximal to the first end wall 112, and is spaced apart from the second portion (1112*b*) proximal to the second end wall 113.

With reference to FIGS. 4 and 7, the locking member 4 is movably disposed on the shaft member 3 and is removably engaged with the base seat 11 such that the support unit 10 is shiftable between a locked state and a released state.

When the support unit 10 is in the locked state, the shaft member 3 is positioned in the ready position, the middle tubular piece 33 is retreated into the fixed tubular piece 32, and the inner tubular piece 34 is retreated into the middle tubular piece 33. The abutted end 421 of the locking portion 42 abuts against the middle tubular piece 33, the engaging end 422 is engaged in the engaging slot 115. Thus, the locking portion 42 is engaged with the base seat 11 such that the shaft member 3 is not rotatable relative to the base seat 11.

With reference to FIGS. 4, 6 and 7, when the support unit 10 is in the released state, the shaft member 3 is extended, the retreat hole 331 of the middle tubular piece 33 is aligned with the locking portion 42 to permit the abutted end 421 of the locking portion 42 to be retreated into the retreat hole 331, and the engaging end 422 of the locking portion 42 is disengaged from the engaging slot 115. Hence, the locking member 4 is released from engagement with the base seat 11 such that the shaft member 3 is rotatable relative to the base seat 11 toward the swung position.

With reference to FIGS. 1 and 6, the foldable device is shiftable between a folded state and a spread state. When the foldable device is in the folded state, the shaft member 3 is in the ready position, where the support shafts 2 extend parallel to the shaft member 3, each of the shaft member 3 and the support shafts 2 is in a retracted state, the support unit 10 is in the locked state, and the foldable unit 30 is collapsed on the upper ends of the shaft member 3 and the support shafts 2. During the shifting of the foldable device from the folded state to the spread state, each of the shaft member 3 and the support shafts 2 is extended, and the support unit 10 is shifted from the locked state to the released state, where the locking member 4 is released from engagement with the base seat 11, and the biasing force of the biasing member 20 urges the second arm portion 203 to abut against the abutted protrusion 313 to rotate the shaft member 3 to the swung position. At this stage, the lower portion of the inner tubular piece 34 of the shaft member 3 presses and brings the lower portions of the support shafts 2 to rotate and spread relative to the base seat 11 and to be inclined and intersect one another. The lower portions of the shaft member 3 and the support shafts 2 stand on the ground surface. The foldable unit 30 is spread out by the shaft member 3 and the support shafts 2.

It is noted that, in various embodiments, the number of the biasing member 20 may be varied. For example, three of the biasing members 20 may be disposed on the support shafts 2 and the shaft member 3, respectively.

Thus, with the biasing member 20 which urges the shaft member 3 to rotate to the swung position, and the shaft member 3 actuating the support shafts 2, the shaft member 3 and the support shafts 2 are automatically rotatable, spread out and kept in the spread state.

Figure 11:
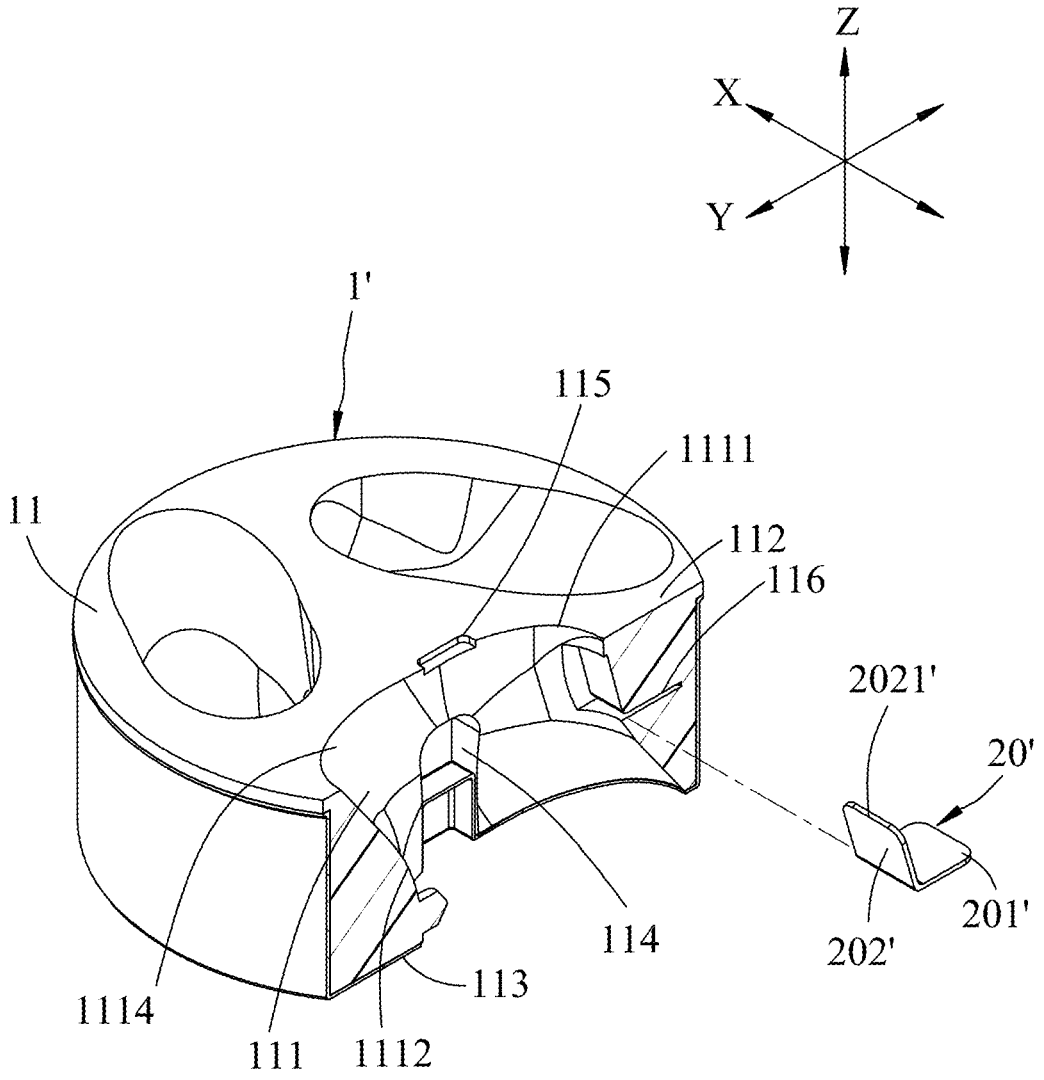
FIG. 11 is a fragmentary, exploded perspective view illustrating a pivot base and a biasing member of another embodiment of the foldable device according to the disclosure.
Figure 12:
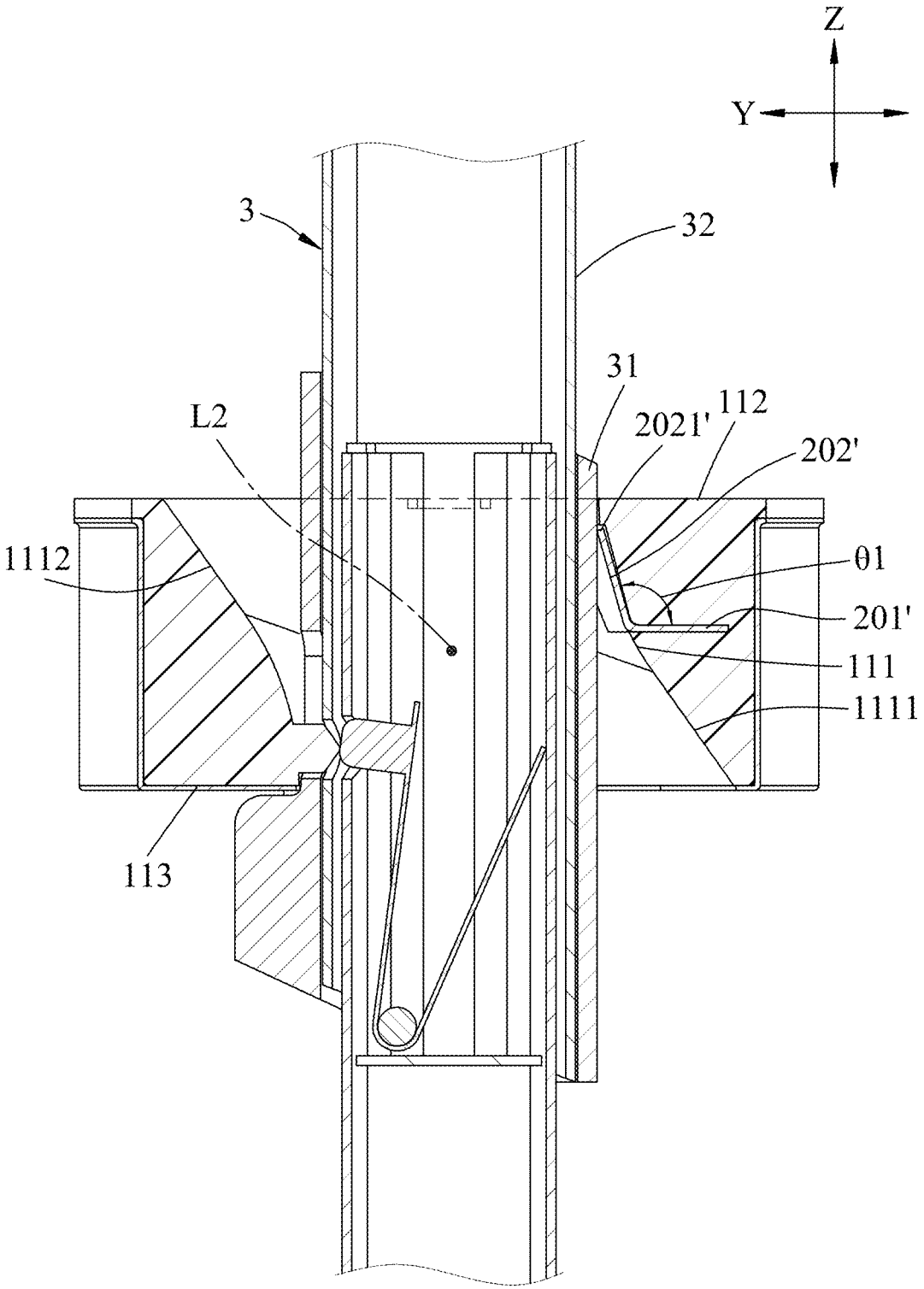
FIG. 12 is a sectional view of the embodiment of FIG. 11, illustrating a shaft member in a ready position.
Figure 13:
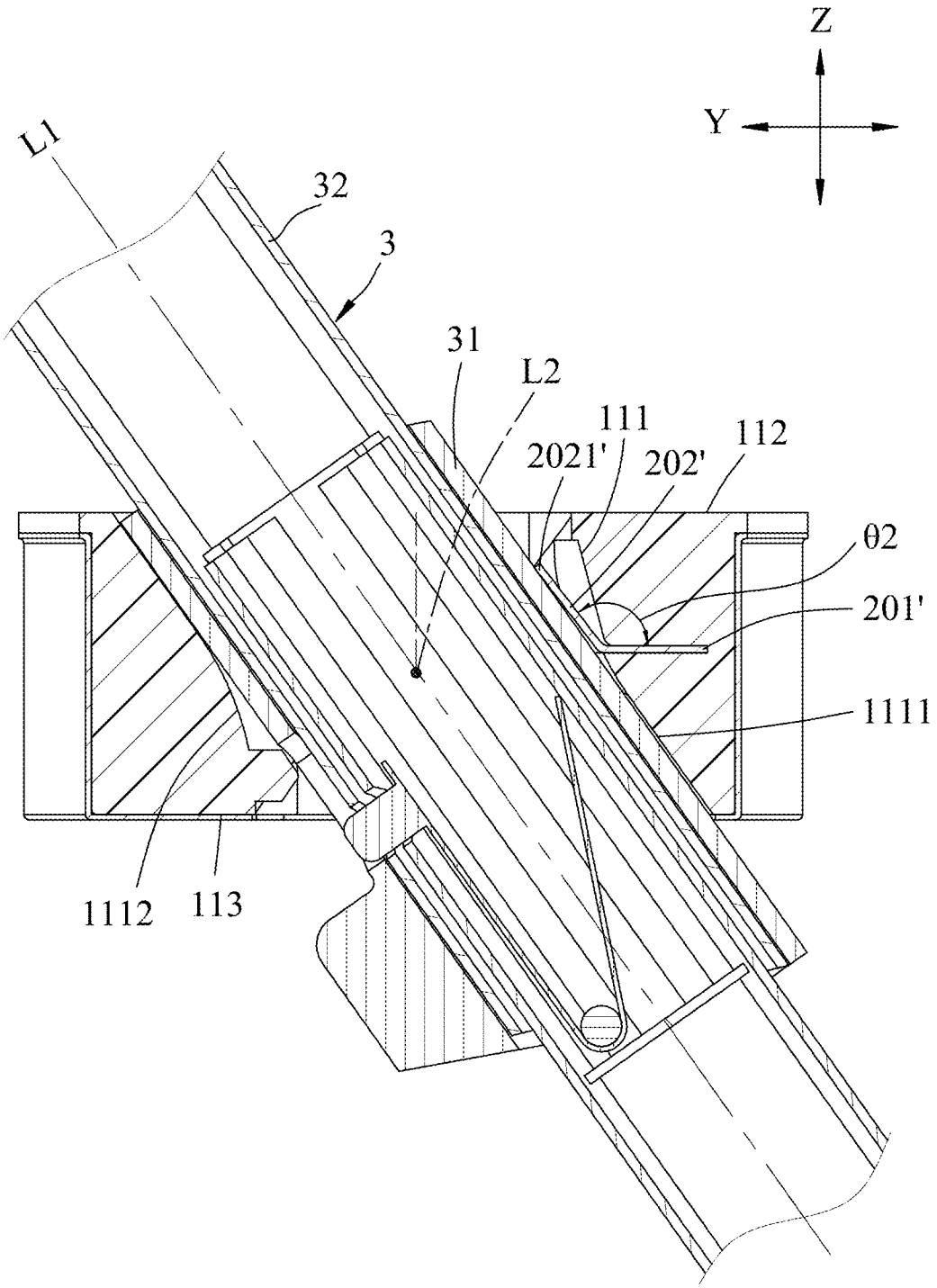
FIG. 13 is a sectional view similar to FIG. 12, illustrating the shaft member in a swung position.

With reference to FIGS. 11 to 13, in another embodiment, a pivot slot 114 is formed in the second connecting wall section 1114 of the inner seat wall 111 of the pivot base 1'. The first inner wall section 1111 of the inner seat wall 111 has a retaining groove 116 formed therein. The biasing member 20' is in the form of a V-shaped leaf spring, and has a retained portion 201' inserted into the retaining groove 116, and a biasing portion 202' extending from the retained portion 201' toward the first end wall 112 to terminate at a biasing end 2021'. The biasing member 20' has a torque applied to the pivot seat 31. The torque is generated as a result of bending of the biasing portion 202' relative to the retained portion 201'.

The biasing end 2021' abuts against the pivot seat 31 at a position between the rotating axis (L2) and the first end wall 112 along the first direction (Z). Hence, the shaft member 3 is rotated about the rotating axis (L2) relative to the base seat 11 when the biasing end 2021' urges the pivot seat 31 with the torque. Also, since the biasing member 20' is located between the shaft member 3 and the first inner wall section 1111 along the third direction (Y), the direction of the torque applied to the shaft member 3 is coincident with the rotational direction of the shaft member 3, so the torque may be fully applied to the shaft member 3 to decrease energy loss of the biasing member 20'.

When the shaft member 3 is in the ready position, as shown in FIG. 12, the biasing end 2021' of the biasing portion 202' abuts against the shaft member 3 and is pressed toward the first inner wall section 1111, and the biasing portion 202' is bent relative to the retained portion 201' at a biasing angle (θ1) to store a biasing returning force to the biasing member 20'. When the biasing returning force is released, the biasing end 2021' of the biasing portion 202' urges the shaft member 3 away from the first inner wall section 1111, the biasing portion 202' is bent relative to the retained portion 201' at a released angle (θ2) that is larger than the biasing angle (θ1), and thus the shaft member 3 is rotated to the swung position, as shown in FIG. 13. Therefore, with the biasing member 20' urging the shaft member 3 to rotate to the swung position, the shaft member 3 and the support shafts 2 are automatically rotatable, spread out and kept in the spread state. In other modified embodiments, the number of the biasing members 20' may be three, and the biasing members 20' are disposed on the support shafts 2 and the shaft member 3, respectively.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A foldable device, comprising:

a support unit including a pivot base, two support shafts and a shaft member, said pivot base including a base seat, a through hole and two support holes, each of which extends through said base seat in a first direction, said support shafts respectively extending through said support holes and being pivotably connected with said base seat, said shaft member extending through said through hole and along a central axis, said shaft member being pivotably connected with said base seat to be rotatable relative to said base seat about a rotating axis which is transverse to a direction of the central axis, such that said shaft member is rotatable relative to said base seat between a ready position, where said shaft member extends parallel to the first direction, and a swung position, where said shaft member is inclined relative to the first direction by an inclined angle; and a biasing member in form of a coil spring to have a torque which urges said shaft member to rotate toward the swung position, wherein, when said shaft member is in the ready position, said support shafts extend parallel to said shaft member, and wherein, during rotation of said shaft member to the swung position, said shaft member actuates said support shafts to rotate and spread relative to said base seat and to be inclined and intersect one another, said biasing member having a coil portion interposed between said shaft member and said base seat, a first arm portion extending from an end of said coil portion and abutting against said base seat, and a second arm portion extending from an opposite end of said coil portion and abutting against said shaft member, wherein said base seat has a pivot slot formed adjacent to said through hole, and said shaft member has a pivot seat, said pivot seat having a seat wall, a pivot pin which projects from said seat wall and which is rotatably disposed in said pivot slot, and an abutted protrusion which projects from said seat wall, said second arm portion of said biasing member being disposed between said first arm portion and said abutted protrusion and abutting against said abutted protrusion, said pivot pin extending along the rotating axis and through said coil portion.

2. The foldable device of claim 1, wherein said biasing member is disposed to have said first arm portion and said second arm portion closer to each other when said shaft member is in the ready position, and remoter from each other when said shaft member is in the swung position.

3. The foldable device of claim 1, wherein said pivot slot includes a first slot section for receiving said pivot pin therein, and a second slot section in communication with said first slot section and for said abutted protrusion to be movably received therein.

4. The foldable device of claim 1, wherein said base seat has an inner seat wall which defines said through hole, a first end wall and a second end wall which are respectively connected with two sides of the inner seat wall along the first direction and opposite to each other, the rotating axis extending along a second direction that is transverse to the first direction, said inner seat wall having a first inner wall section and a second inner wall section which are opposite to each other along a third direction that is transverse to both the first direction and the second direction, and at two sides of said through hole, respectively, and a first connecting wall section which interconnects said first inner wall section and said second inner wall section and on which said shaft member is pivotably disposed, each of said first inner wall section and said second inner wall section extending and being inclined relative to the first direction, said biasing member being connected between said first connecting wall section and said shaft member such that, when said shaft member is in the ready position, a first side of said shaft member facing said first inner wall section abuts against a first portion of said first inner wall section proximate to said first end wall, and is spaced apart from a second portion of said first inner wall section proximate to said second end wall, and a second side of said shaft member facing said second inner wall section abuts against a second portion of said second inner wall section proximate to said second end wall, and is spaced apart from a first portion of said second inner wall section proximate to said first end wall, and such that, when said shaft member is in the swung position, said first side of said shaft member abuts against said second portion of said first inner wall section and is spaced apart from said first portion of said first inner wall section, and said second side of said shaft member abuts against said first portion of said second inner wall section and is spaced apart from said second portion of said second inner wall section.

5. The foldable device of claim 1, wherein said support unit further includes a locking member movably disposed on said shaft member and removably engaged with said base seat such that, when said locking member is engaged with said base seat, said shaft member is positioned in the ready position to prevent rotation of said shaft member relative to said base seat, and such that, when said locking member is released from engagement with said base seat, said shaft member is rotatable relative to said base seat toward the swung position.

6. A foldable device, comprising:

a support unit including a pivot base, two support shafts and a shaft member, said pivot base including a base seat, a through hole and two support holes, each of which extends through said base seat in a first direction, said support shafts respectively extending through said support holes and being pivotably connected with said base seat, said shaft member extending through said through hole and along a central axis, said shaft member being pivotably connected with said base seat to be rotatable relative to said base seat about a rotating axis which is transverse to a direction of the central axis, such that said shaft member is rotatable relative to said base seat between a ready position, where said shaft member extends parallel to the first direction, and a swung position, where said shaft member is inclined relative to the first direction by an inclined angle; and a biasing member interposed between said base seat and said shaft member to have a torque which urges said shaft member to rotate toward the swung position, wherein, when said shaft member is in the ready position, said support shafts extend parallel to said shaft member, and wherein, during rotation of said shaft member to the swung position, said shaft member actuates said support shafts to rotate and spread relative to said base seat and to be inclined and intersect one another, wherein said base seat has an inner seat wall which defines said through hole, a first end wall and a second end wall which are respectively connected with two sides of the inner seat wall along the first direction and opposite to each other, said inner seat wall having a retaining groove formed therein, said biasing member being in form of a V-shaped leaf spring, and having a retained portion inserted into said retaining groove, and a biasing portion extending from said retained portion toward said first end wall to terminate at a biasing end such that, when said shaft member is in the ready position, said biasing end of said biasing portion abuts against said shaft member and is pressed toward said inner seat wall, and said biasing portion is bent relative to said retained portion at a biasing angle, and such that, when said shaft member is in the swung position, said biasing end of said biasing portion urges said shaft member away from said inner seat wall, and said biasing portion is bent relative to said retained portion at a released angle that is larger than the biasing angle.

7. The foldable device of claim 6, wherein said support unit further includes a locking member movably disposed on said shaft member and removably engaged with said base seat such that, when said locking member is engaged with said base seat, said shaft member is positioned in the ready position to prevent rotation of said shaft member relative to said base seat, and such that, when said locking member is released from engagement with said base seat, said shaft member is rotatable relative to said base seat toward the swung position.

* * * * *